US006049765A

United States Patent [19]

Iyengar et al.

[11] Patent Number: 6,049,765

[45] Date of Patent: Apr. 11, 2000

[54] SILENCE COMPRESSION FOR RECORDED VOICE MESSAGES

[75] Inventors: Vasu Iyengar; Syed S. Ali, both of Allentown, Pa.

[73] Assignee: Lucent Technologies Inc., Murray Hill, N.J.

[21] Appl. No.: 08/995,519

[22] Filed: Dec. 22, 1997

[51] Int. Cl.[7] ..... G10L 19/02

[52] U.S. Cl. ..... 704/201; 704/210; 704/215; 379/88.1

[58] Field of Search ..... 704/500, 501, 704/504, 215, 210, 201, 503, 205, 206, 208, 209, 203, 214; 386/27, 33; 379/88.1

[56] References Cited

U.S. PATENT DOCUMENTS

| | | | |
|---|---|---|---|
| 4,376,874 | 3/1983 | Karban et al. | 704/215 |
| 4,412,306 | 10/1983 | Moll | 708/203 |
| 4,696,039 | 9/1987 | Doddington | 704/215 |
| 5,448,679 | 9/1995 | McKiel, Jr. | 704/208 |
| 5,506,872 | 4/1996 | Mohler | 375/240 |
| 5,657,420 | 8/1997 | Jacobs et al. . | |
| 5,742,930 | 4/1998 | Howitt | 704/502 |
| 5,978,757 | 11/1999 | Newton | 704/217 |

*Primary Examiner*—David R. Hudspeth
*Assistant Examiner*—Abul K. Azad

[57] ABSTRACT

A silence compression system that improves data compression in a digital speech storage device, such as a digital telephone answering machine, without undue clipping of voice signals. Instead of employing only real-time compression, the inventive silence system analyzes and compresses or re-compresses digital speech samples stored previously, when the voice messaging system is off-line or otherwise in a low priority state. A method of silence compression comprises receiving real-time speech samples, storing the same in memory, and analyzing the stored speech samples at a later time to determine thresholds for periods of silence. The periods of silence are then compressed, and the silence compressed voice message is restored in memory. In this fashion, the processor is not required to make a silence period determination on-the-fly simultaneous with encoding and compression of the real-time voice message, and thus is not subjected to heavy processor loads typically encountered in real time. This enables more efficient compression of speech samples, lighter duty processors, and improved voice quality upon reproduction by eliminating undesired clipping of the voice signal encountered in prior systems after periods of silence. The silence compressed speech samples are stored in a storage device for subsequent playback.

35 Claims, 3 Drawing Sheets

SILENCE COMPRESSION FOR RECORDED VOICE MESSAGES

BACKGROUND OF THE INVENTION

1. Field of the Invention

This invention relates to data compression schemes for digital speech processing systems. More particularly, it relates to the minimization of voice storage requirements for a voice messaging system by improving the efficiency of the speech compression.

2. Background of Related Art

Voice processing systems that record digitized voice messages generally require significant amounts of storage capacity. The amount of memory required for a given time unit of a voice message typically depends on the sampling rate. For instance, a sampling rate of 8,000 eight-bit samples per second yields 480,000 bytes of data for each minute of a voice message using linear, $\mu$-law or A-law encoding or compression. Because of these large amounts of data, storage of linear, $\mu$-law or A-law compressed speech samples is impractical in most instances. Accordingly, most digital voice messaging systems employ speech compression or speech coding techniques to reduce the storage requirements of voice messages.

A common speech encoding/compression algorithm used for speech storage is code excited linear predictive (CELP) based coding. CELP-based algorithms reconstruct speech signals based on a digital model of the human vocal tract. They provide frames of an encoded, compressed bit stream and include short-term spectral linear predictor coefficients, voicing information and gain information (frame and sub frame-based) reconstructable based on a model of the human vocal tract. Whether speech compression can or should be employed often depends on the desired quality of the speech upon reproduction, the sampling rate of the real-time speech, and the available processing capacity to handle speech compression and other associated tasks on-the-fly before storage to voice message memory. CELP bit rates vary, e.g., up to 6.8 Kb/s or more.

One technique used to further maximize the data compression of voice messages eliminates the encoding of portions corresponding to silence, pauses or just background noise in the real-time voice message. In the past, compression of silence periods in stored speech has been attained by removing each frame of compressed speech determined on-the-fly to contain only silence, pauses or background noise in speech. This analysis requires a significant portion of processing capability to occur simultaneously with other processes such as the encoding of the voice message.

Unfortunately, removal of frames of silence on-the-fly may undesirably introduce clipping of initial or final portions of spoken words. This clipping is irreversibly lost as the on-the-fly decisions made by these conventional systems are irreversible. Also, there is a finite look-ahead capacity of the processor relative to the incoming voice signal, e.g., a look up of only the current CELP frame of approximately 20 to 25 milliseconds (mS). As a result, the quality of reproduced speech which was silence compressed on-the-fly may be undesirably decreased.

A digital signal processor (DSP) or other processor is conventionally used to compress a voice signal into compressed digital samples in real-time or near real-time to reduce the amount of storage required to store the voice message. In some conventional systems, the DSP also performs speech analysis to ascertain and suppress silence or pause periods in the speech signal before encoding and storage of the voice message. However, in prior art systems the speech analysis is performed in real-time along with the compression of the voice message, requiring a powerful processor to handle the tasks of both speech compression and speech analysis simultaneously.

FIG. 3 illustrates the clipping of a portion of a real-time speech signal in more detail. FIG. 3 shows a real-time speech signal 402 with respect to a threshold noise level 400 determined by a conventional, real-time, time domain-based speech analysis. The threshold noise level 400 represents the maximum level of background noise or other unwanted information in speech signal 402, determined on a real-time basis from past speech only. Those portions of the speech signal 402 having levels above threshold noise level 400 are encoded and stored. However, speech samples that would otherwise be generated during silence periods or pauses in the real-time speech signal 402 lying below the threshold noise level 400 are discarded and replaced with the storage of a variable indicating a length of time and level of the silence period or pause.

Encoding and storage of compressed samples of the voice message resumes after it is determined that the silence period or pause has been interrupted by a signal above the threshold noise level 400. The threshold level 400 is adaptive to account for varying background noise levels. An analysis of the real-time speech signal 402 and determination of the exact point in time to resume encoding and storage of samples after a silence period or pause requires a certain amount of processing time. Because the look-ahead range is limited during real-time processing to avoid introducing excessive delays and buffering, the voice messaging system might not encode and store a portion of the analog real-time speech signal 402 between the points $t_1$ and $t_2$ immediately after the analog real-time speech signal 402 exceeds the threshold noise level 400. Thus, a portion of the analog real-time speech signal 402 may be undesirably clipped from the stored voice message and replaced with silence.

Because the extent of processor loading to perform encoding or compression varies according to the nature of the voice signal and other factors, it is possible that at times the performance of both the compression and speech analysis processes may exceed processor capacity. When this happens, the system may forego speech analysis functions such as silence compression entirely, resulting in a lessened efficiency of the compression routines and an increased storage requirement for the compressed voice message.

FIG. 4 shows a conventional silence compression technique wherein real-time speech is analyzed and compressed on-the-fly based on the time-based detection of periods of silence.

In FIG. 4, real-time analog speech is analyzed in the time domain in a time domain analysis module 320, then presented to a speech/silence decision module 300. Speech/silence decision module 300 determines if the current real-time speech is above or below a particular noise threshold, which is determined by conventional on-the-fly time-domain techniques. If the current real-time speech is above the noise threshold, it is presumed that the speech is non-silence, and if it is below the noise threshold, it is presumed that the current speech signal is related to a period of silence. However, the on-the-fly time domain analysis of speech to determine periods of silence, background noise or pauses in speech performed in conventional systems suffers from poor performance under poor signal-to-noise (S/N) ratio conditions.

In particular, the real-time speech is input to speech encoder 302 for compression into CELP frames, which are stored in memory 304 of the voice messaging system. When the real-time speech signal contains voice or other audible sounds above the noise threshold level, the voice is compressed into frames of CELP encoded data by speech encoder 302, which are then stored in memory 304. However, when the speech/silence decision module 300 determines that the real-time speech contains only a pause or is otherwise below the currently determined noise threshold level, encoding by speech encoder 302 is paused and a counter is started which represents the number of CELP frames containing only silence. Once voice or other audible sounds above the threshold level appear in the real-time speech signal, the last value of the silence frame counter and level is stored in memory 304, speech encoder 302 is re-activated, and the storage of CELP encoded data frames in memory 304 resumes. The threshold of the background noise is updated in the update background noise level module 306. The speech/silence decision module 300, the speech encoder 302, and the update background noise level module 306 are all included within a DSP.

It is important to note that in conventional techniques, the noise threshold is determined based on current and past conditions, usually in the time domain, of the real-time analog speech signal, and can only affect future (not past) encoding of the real-time speech. Although spectral analysis methods are known, they require a significant amount or processing power and typically are not practical to implement in real-time, on-the-fly applications. Thus, if the noise floor suddenly drops, the speech/silence decision module 300 may not respond immediately and portions of non-silence real-time speech may be clipped. Similarly, if the noise floor suddenly rises, the determination of silence periods in the real-time speech may not be optimized fully.

There is a need for an efficient silence compression technique which properly and accurately discriminates speech from silence, particularly when the noise floor suddenly changes, and which does not overburden the processing ability of the voice messaging system.

SUMMARY OF THE INVENTION

In accordance with the principles of the present invention, a silence compression method includes retrieving a previously stored compressed speech message from memory, which is then analyzed to determine a parameter which indicates periods of silence in the compressed speech message. The periods of silence are then removed from the retrieved compressed speech message based on the determined parameter, and the silence compressed speech message is restored to memory.

A voice messaging system incorporating the inventive off-line speech compression comprises an input to receive real-time digital speech samples based on a real-time analog speech message. A speech encoder compresses the real-time digital speech samples, which are stored in a storage device. A module retrieves the stored, compressed digital speech samples from the storage device, removes periods of silence therefrom, and restores silence compressed digital speech samples in memory to allow subsequent playback of a voice message representative of the input real-time analog speech message.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

Figure 1:
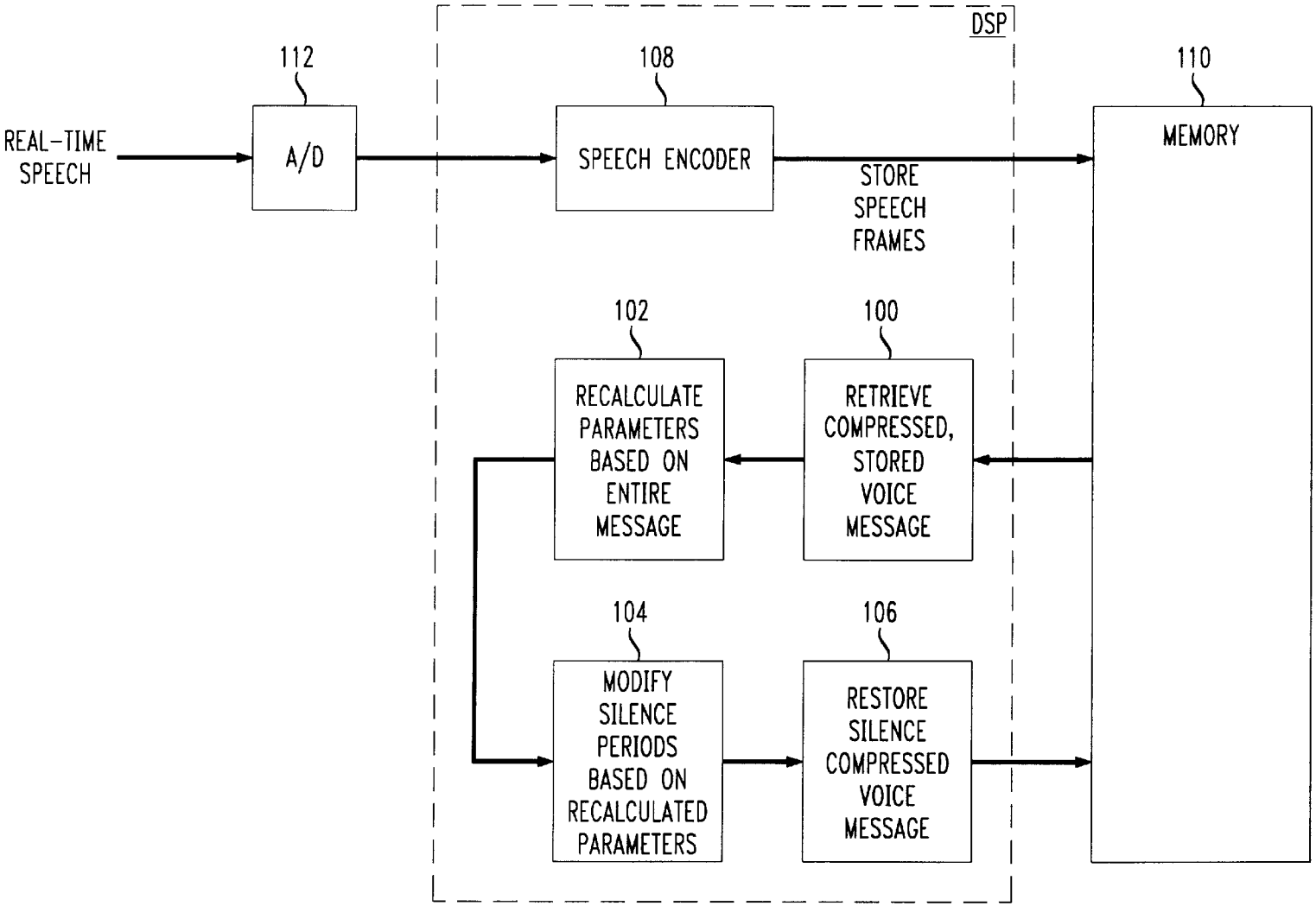
FIG. 1 is a functional block diagram depicting the silence compression of a stored voice message according to the principles of the present invention.

FIG. 1 depicts a functional block diagram of the retrieval, analysis, and re-storage of a compressed voice message in a voice messaging system in accordance with the principles of the present invention.

FIG. 1 shows a real-time speech signal input to a conventional analog-to-digital (A/D) converter 112, which outputs digital samples to a speech encoder 108. The A/D converter 112 may be any suitable A/D device, e.g., providing a linear, $\mu$-law, A-law, ADPCM or sigma-delta ($\Sigma/\Delta$) output signal.

The speech encoder 108 receives the output from the A/D converter 112 and implements any suitable, conventional compression technique, including but not limited to CELP, Linear Predictive Coding (LPC) or Adaptive Differential Pulse Code Modulation (ADPCM). According to the principles of the present invention, silence compression in a voice message is performed after the voice message is initially received and stored in memory 110. However, in accordance with the principles of the present invention, silence compression performed after the voice message is initially stored in memory 110 may augment silence compression performed on-the-fly before initial storage.

In operation, the A/D converter 112 samples an analog speech signal in real time, e.g., at a rate of 8 Khz, to generate linear, $\mu$-law, A-law, ADPCM or $\Sigma/\Delta$ digital speech samples. Speech encoder 108 encodes and compresses the digital speech samples and stores the compressed voice message in memory 110.

After the voice message is received, encoded and stored in memory 110, the voice messaging system presumably enters a slower period wherein there is more available processor time than there is at the time that the voice message is being received, encoded and stored. At this or any other slower time, the increased available power of the DSP can be utilized to retrieve, analyze and re-process the compressed, stored voice messages.

For instance, the compressed, stored voice messages can be retrieved from memory 110, re-analyzed to determine parameters better and more accurately with non-real-time powerful algorithms, and re-compressed and re-stored based on the more accurately determined parameters. FIG. 1 shows an example of re-analyzing the stored, compressed voice messages to identify and modify silence periods or pauses more accurately.

In particular, the stored, compressed voice messages are retrieved by module 100. Parameters such as a threshold noise level are re-calculated in module 102 based not only on the present and past levels of the speech signal, as in prior art systems, but also on future levels of the voice message. In other words, the entire voice message can be analyzed and re-analyzed to best determine parameters related to periods of silence. Thus, in later determining the beginning and end of silence periods or pauses in the speech signal, the determination can be made with a priori knowledge of any sudden changes in the noise level.

During the one or more passes through time domain and/or spectral analysis to determine the silence, pause or background noise periods, information within the compressed message itself may be utilized. For example, CELP voicing information such as pitch gain may be analyzed to determine the silence, pause or background noise periods. During such periods, there is not much voicing and thus the pitch gain would be expected to be small. Conversely, during periods containing voice the voicing information such as pitch gain would be expected to be higher.

During the off-line analyses, spectral information may be extracted from the compressed data. Moreover, given the relaxed time constraints allowed by off-line silence compression, the compressed speech may be decompressed and analyzed in the time domain and/or spectrally to determine and corroborate and further refine the decisions of the locations of silence, pauses and/or background noise portions in module 102.

A spectral analysis may be used to augment a decision made in the time domain. For instance, the stored voice message may be decoded or decompressed and analyzed in the time domain, or previous analysis performed in the time domain may be used as a first, temporary decision as to the portions containing only silence, pauses or background noise. Then, spectral information may be analyzed in the silence regions to verify if in fact the temporarily determined silence, pause or background noise portions are accurate. For example, spectral variation in the silence, pause or background noise portions would be expected to be minimal, whereas portions of the voice message containing speech would be expected to contain significant amounts of spectral variation.

The silence periods or pauses determined in module 102 are modified in module 104 based on the more accurate, re-calculated parameters established in module 102.

For instance, in one embodiment module 104 reduces the bit rate of the encoded silence period such that it results in a greater compression ratio for the portions of the voice message which contain only or substantially only silence periods. In another embodiment of module 104, the silence periods are removed.

Finally, the silence compressed voice message is re-stored in memory 110 as depicted by module 106 and the voice messaging system otherwise operates in a conventional manner.

Figure 2:
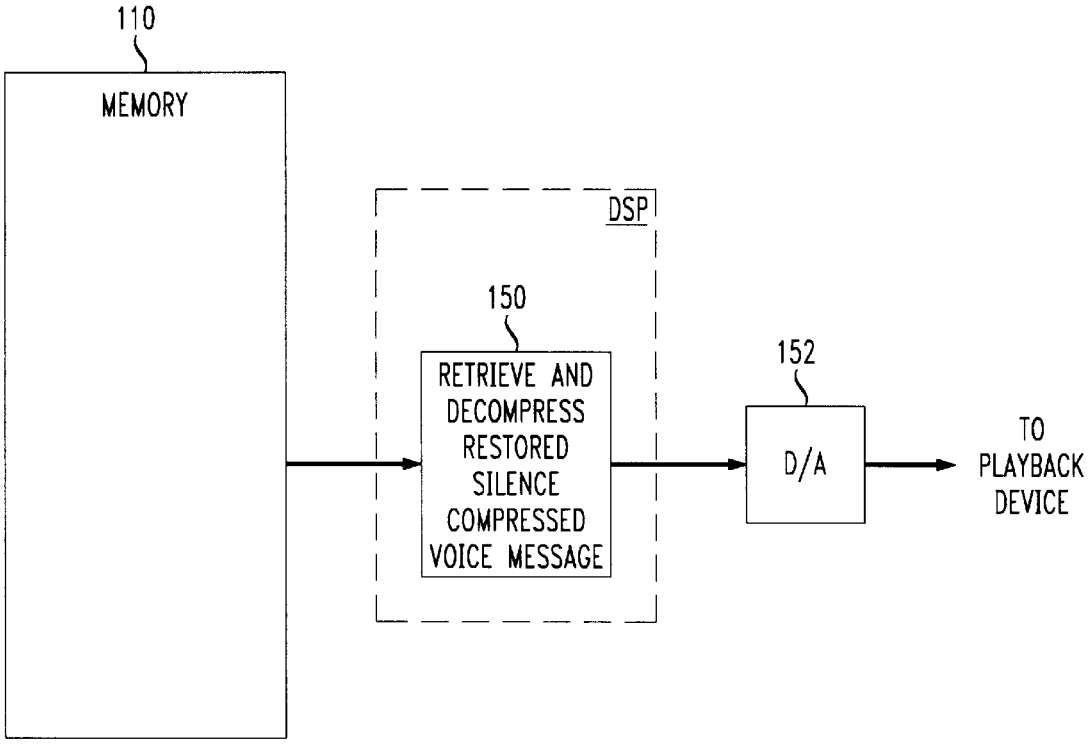
FIG. 2 is a functional block diagram depicting the silence decompression and playback of a voice message in accordance with the principles of the present invention.
Figure 3:
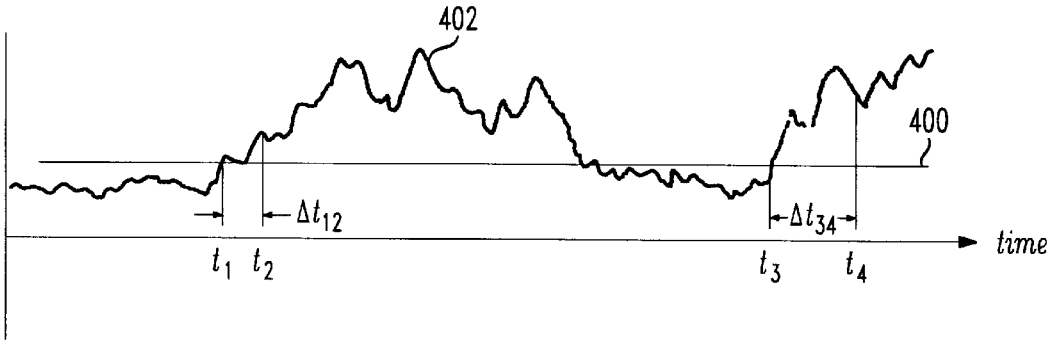
FIG. 3 PRIOR ART
FIG. 3 is a timing diagram useful for illustrating undesired clipping of voice information in prior compression and storage systems.
Figure 4:
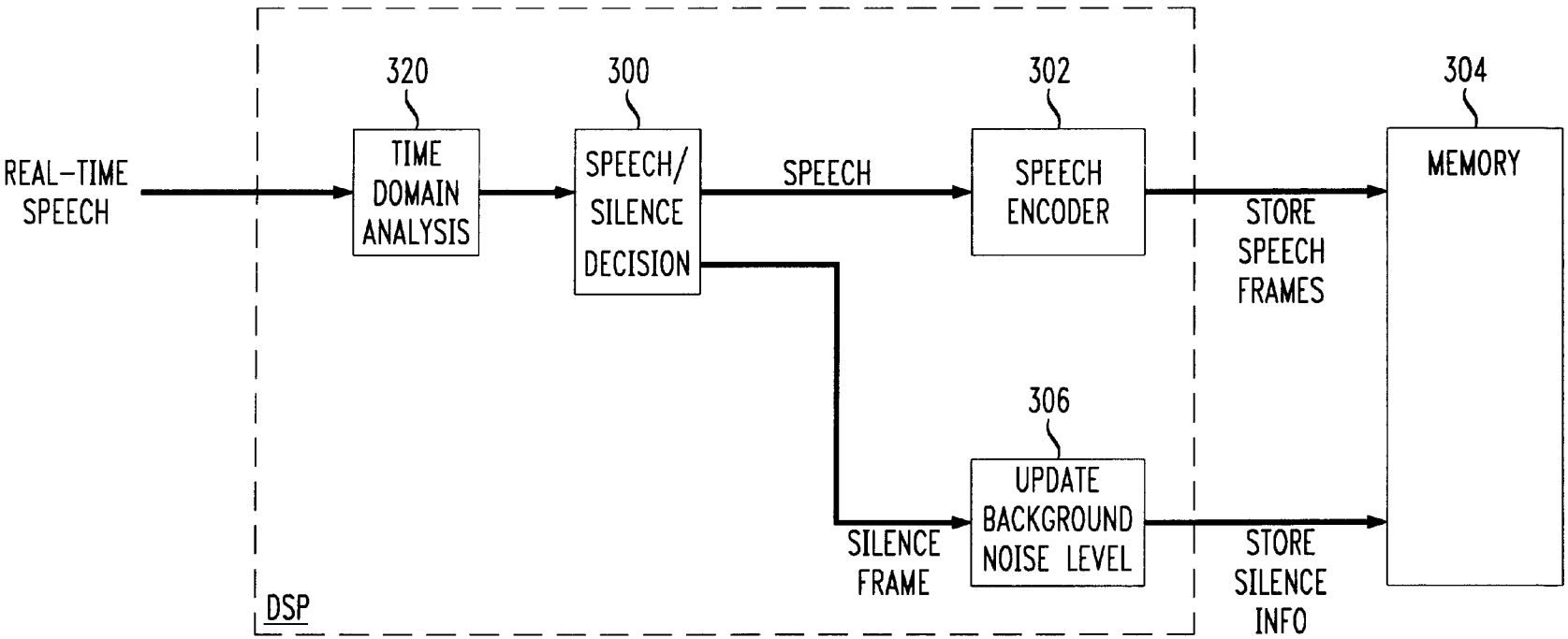
FIG. 4 PRIOR ART
FIG. 4 is a functional block diagram depicting conventional speech compression.

FIG. 2 shows the portion of the DSP which retrieves the voice message for playback. In particular, a module 150 retrieves the silence compressed voice message from memory 110, and decompresses the silence compressed voice message using a process complementary to the encoding performed in the speech encoder 108, and by reversing the modification performed in module 104. For instance, if the silence periods were removed in module 104, then module 150 replaces the silence, pause or background noise periods with a synthesized silence signal during the periods for which silence was removed by the modify silence periods module 104. If the bit rate of the silence periods was reduced by module 104, then module 150 decompresses the silence periods stored at the higher compression ratio. Thereafter, the decompressed voice messages are converted to an analog signal in an analog-to-digital converter (D/A) 152, and communicated to a playback device for otherwise conventional playback.

The off-line silence compression can be performed automatically. For instance, soon after a telephone call which left a voice message is terminated, the voice message can be automatically retrieved, silence compressed, and restored in memory. The silence compression may, in yet another embodiment, perform silence compression on particularly selected voice messages on an automatic basis. For instance, silence compression may be based on the age of a particular voice message, e.g., if not deleted five days after receipt and storage.

Alternatively, the silence compression can be performed on select voice messages stored in memory 110. The selection of voice messages which are to be off line silence compressed can be made on the basis of various criteria. For instance, the user can manually (or under software control) instruct that silence compression be performed on all voice messages received after the manual selection.

In another embodiment, the user can manually (or under software control) instruct the performance of off line silence compression on all (or selected) voice messages already stored in memory 110.

In yet another embodiment, the silence compression may be selected to be performed on particular voice messages after the voice message is first played back. In this way, the message is initially listened to at perhaps its highest quality, then automatically off line silence compressed and re-stored, should the user not delete the voice message after playing it back.

In a further embodiment the silence compression may be performed based on the remaining capacity of the voice memory. For example, silence compression may be performed off line on stored voice messages to maximize the available voice memory as the voice memory reaches capacity.

The off-line analysis and re-processing of the previously-stored, compressed voice messages allows greater flexibility in the choice of processor, encoding used, and analyses performed. For instance, because the voice message is already stored in memory 110, the DSP or processor is relieved from the time and processor constraints normally associated with real-time processing. Thus, a lower "million instructions per second (MIPS) DSP or processor can be implemented. Moreover, because much of the time that a voice processing system is in operation the processor is off-line or otherwise in a light loading condition, the DSP or processor may then implement analysis and/or re-encoding routines which require large amounts of time to complete. Analysis of the compressed, stored voice message may also be performed in a frequency domain, which typically requires more processor time and power than the time domain, as well as in the time domain, to better determine parameters such as the threshold noise level.

Re-processing and analysis of voice messages in accordance with the present invention may be interrupted by higher priority real-time functions such as the real-time reception of a new voice message. Nevertheless, processor requirements are significantly reduced because the analysis of the speech signal is not performed in real-time, and is not performed simultaneously with the encoding of the speech signal.

Thus, the present invention analyzes speech signals and performs silence compression off-line based on more accurately determined parameters, and either replaces entirely or augments silence compression performed on-line, to modify silence periods without undesired clipping or excessive .

A principal aspect of the present invention lies in the use of an off-line silence compression scheme which is performed after a voice message is compressed and stored in memory. The above description is intended to be illustrative rather than limiting, and thus, we embrace within our invention all that subject matter that may come to those skilled in the art in view of the teachings herein.

What is claimed is:

1. A silence compression method, comprising:

retrieving a previously stored compressed speech message from memory;

analyzing said previously stored compressed speech message to determine a spectral property of said previously stored compressed speech message;

modifying said previously stored compressed speech message based on said spectral property to produce a silence compressed speech message; and storing said silence compressed speech message to said memory.

2. The silence compression method according to claim 1, wherein:

said modification removes periods of significant silence.

3. The silence compression method according to claim 2, further comprising:

decompressing said silence compressed speech message.

4. The silence compression method according to claim 1, further comprising:

re-instating said periods of significant silence, removed during said modification, in said decompressed silence compressed speech message.

5. The silence compression method according to claim 1, wherein:

said modification increases a compression ratio of periods of significant silence.

6. The silence compression method according to claim 1, wherein:

said analysis indicates periods of silence in said previously stored compressed speech message.

7. The silence compression method according to claim 1, wherein:

said spectral property is a threshold noise level.

8. The silence compression method according to claim 1, wherein said analyzing step includes:

performing a spectral analysis on an entire portion of said previously stored compressed speech message to determine said spectral property.

9. The silence compression method according to claim 1, wherein:

said method is performed automatically without user intervention, after a voice message is initially received.

10. The silence compression method according to claim 1, wherein:

said method is performed on said previously stored compressed speech message after said previously stored compressed speech message is played back at least a first time.

11. The silence compression method according to claim 1, wherein:

said method is performed on said previously stored compressed speech message after said previously stored compressed speech message reaches a predetermined age.

12. The silence compression method according to claim 1, wherein:

said method is performed on said previously stored compressed speech message upon user selection.

13. A voice messaging system including off-line speech compression, comprising:

an input to receive real-time digital speech samples based on a real-time analog speech message;

a speech encoder to generate compressed digital speech samples by compressing said real-time digital speech samples received by said input;

a storage device connected to said speech encoder to store said compressed digital speech samples; and a module to retrieve said stored compressed digital speech samples from said storage device, to analyze said retrieved compressed digital speech samples to determine a spectral property of said real-time analog speech message, to modify periods of silence of said retrieved compressed digital speech samples based on said determined spectral property to generate silence compressed digital speech samples, and to store said silence compressed digital speech samples in said storage device.

14. The voice messaging system according to claim 13, wherein:

said modification removes said periods of silence.

15. The voice messaging system according to claim 14, further comprising:

a speech decoder adapted to decompress said silence compressed digital speech samples, and to re-instate previously removed periods of silence in said decompressed silence compressed digital speech samples.

16. The voice messaging system according to claim 14, further comprising:

a silence re-instating algorithm to re-instate said periods of silence previously removed in said silence compressed digital speech samples.

17. The voice messaging system according to claim 14, wherein:

said spectral property is a threshold noise level.

18. The voice messaging system according to claim 13, wherein:

said modification increases a compression ratio of said periods of silence.

19. The voice messaging system according to claim 13, further comprising:

a playback module to retrieve said silence compressed digital speech samples from said storage device, to generate analog speech from said silence compressed digital speech samples, and to play back audio corresponding to said real-time analog speech message.

20. The voice messaging system according to claim 13, wherein:

said spectral property is a threshold noise level.

21. The voice messaging system according to claim 13, wherein:

said module is adapted and arranged to operate automatically without user intervention, after said real-time analog speech message is initially received.

22. The voice messaging system according to claim 13, wherein:

said module is adapted and arranged to operate after said compressed digital speech samples are played back at least a first time.

23. The voice messaging system according to claim 13, wherein:

said module is adapted and arranged to operate after said compressed digital speech samples reach a predetermined age.

24. The voice messaging system according to claim 13, wherein:

said module is adapted and arranged to operate upon user selection.

25. A telephone answering device, comprising:

an input to receive real-time digital speech samples based on a real-time analog speech message;

a speech encoder to generate compressed digital speech samples by compressing said real-time digital speech samples received by said input;

a storage device connected to said speech encoder to store said compressed digital speech samples; and a module to retrieve said stored compressed digital speech samples from said storage device, to analyze said retrieved compressed digital speech samples to determine a spectral property of said real-time analog speech message, to modify periods of silence of said retrieved compressed digital speech samples based on said determined spectral property to generate silence compressed digital speech samples, and to store said silence compressed digital speech samples in said storage device.

26. The telephone answering device according to claim 25, wherein:

said modification removes said periods of silence of said retrieved compressed digital speech.

27. The telephone answering device according to claim 26, further comprising:

a speech decoder adapted to decompress said silence compressed digital speech samples, and to re-instate previously removed periods of silence in said decompressed silence compressed digital speech samples.

28. The telephone answering device according to claim 26, further comprising:

a silence re-instating algorithm to re-instate said periods of silence previously removed in said silence compressed digital speech samples.

29. The telephone answering device according to claim 26, wherein:

said spectral property is a threshold noise level.

30. The telephone answering device according to claim 25, further comprising:

a playback module to retrieve said silence compressed digital speech samples from said storage device, to generate analog speech from said silence compressed digital speech samples, and to play back audio corresponding to said real-time analog speech message.

31. The telephone answering device according to claim 25, further comprising:

said module is adapted and arranged to operate automatically without user intervention, after said real-time analog speech message is initially received.

32. The telephone answering device according to claim 25, further comprising:

said module is adapted and arranged to operate after said compressed digital speech samples are played back at least a first time.

33. The telephone answering device according to claim 25, further comprising:

said module is adapted and arranged to operate after said compressed digital speech samples reach a predetermined age.

34. The telephone answering device according to claim 25, further comprising:

said module is adapted and arranged to operate upon user selection.

35. The telephone answering device according to claim 25, wherein:

said modification increases a compression ratio of said periods of silence.

* * * * *